United States Patent [19]

Haney

[11] Patent Number: 4,475,607

[45] Date of Patent: Oct. 9, 1984

[54] CLAMP AND INSERT FOR CLAMPING DRILLING TUBULARS

[75] Inventor: Keith M. Haney, Wichita Falls, Tex.

[73] Assignee: Walker-Neer Manufacturing Co. Inc., Wichita Falls, Tex.

[21] Appl. No.: 329,702

[22] Filed: Dec. 11, 1981

[51] Int. Cl.[3] ..... E21B 7/22; B65H 59/10

[52] U.S. Cl. ..... 175/422; 173/166; 188/67; 269/218; 269/230

[58] Field of Search ..... 24/263 R, 263 D, 263 DA; 269/218, 230; 173/166; 175/422; 188/67

[56] References Cited

U.S. PATENT DOCUMENTS

| | | | |
|---|---|---|---|
| 1,381,074 | 6/1921 | Livergood | 175/422 |
| 1,462,131 | 7/1923 | Clarke | 175/422 |
| 1,508,882 | 9/1924 | Hosmer et al. | 175/422 |
| 1,533,362 | 4/1925 | Babin | 175/422 |
| 1,620,913 | 3/1927 | Orwig | 188/67 |
| 1,834,316 | 12/1931 | McLagan | 175/422 |
| 1,847,087 | 3/1932 | Greve | 188/67 |
| 2,065,140 | 12/1936 | Lundeen | 188/67 |
| 2,589,159 | 3/1952 | Stone | 24/263 DA |
| 2,633,333 | 3/1953 | Storm | 173/165 |
| 3,268,968 | 8/1966 | Crickmer | 24/263 R |
| 3,365,762 | 1/1968 | Spiri | 188/67 |
| 3,742,563 | 7/1973 | Brown | 24/263 R |
| 3,846,877 | 11/1974 | Spiri | 188/67 |
| 3,961,399 | 6/1976 | Boyadjieff | 24/263 DA |
| 4,355,443 | 10/1982 | Blackwell | 24/263 D |
| 4,366,606 | 1/1983 | Willis et al. | 24/263 DA |

*Primary Examiner*—Gene Mancene
*Assistant Examiner*—James Hakomaki
*Attorney, Agent, or Firm*—Willian, Brinks, Olds, Hofer, Gilson & Lione, Ltd.

[57] ABSTRACT

A clamp for drilling tubulars such as drill pipes includes a jaw which defines a cylindrical recess. A cylindrical insert is rotatably mounted within the recess. This insert defines a cylindrically symmetrical toothed surface positioned to grip and frictionally engage the clamped tubular, and a cylindrically convex positioning surface configured to cooperate with the cylindrical recess to hold the insert in place in the jaw. The insert is mounted in the jaw so as to rotate freely within a selected range of rotational positions in order to allow the insert to orient itself as necessary to maximize the area of contact between the insert and the clamped tubular over a range of tubular diameters. The insert is reversible in the recess so as to allow the insert to be positioned in the jaw as necessary to maximize frictional engagement with the clamped tubular in a selected direction of rotation. In one preferred embodiment, the toothed surface is provided with an array of asymmetrical teeth which grip the clamped tubular. Also, locking bars are provided on the jaw which cooperate with recesses in the ends of the insert to restrict the rotational movement of the insert within the recess. Alternate embodiments of the insert employ cylindrically convex, cylindrically concave, or planar toothed surfaces.

18 Claims, 12 Drawing Figures

CLAMP AND INSERT FOR CLAMPING DRILLING TUBULARS

BACKGROUND OF THE INVENTION

This invention relates to an improved clamp utilizing improved inserts for clamping and holding drilling tubulars such as drill pipe. The clamp and inserts of this invention are particularly useful in connection with makeup and breakout wrenches used with drilling rigs for drilling bore holes in earth formations.

During drilling operations it is necessary to screw together threaded lengths of drilling tubulars such as drill pipe and casing. For example, with drill pipe, the threaded joints between adjacent lengths of drill pipe must be tightened to a specified torque (made up) and then later unscrewed from one another (broken out) during the drilling process. It is known to the art to provide makeup and breakout wrenches in drill rigs particularly for the purpose of applying the necessary torques needed to assemble and disassemble a drill string. U.S. patent application Ser. No. 269,279, filed June 1, 1981 and assigned to the assignee of the present invention, discloses one set of such makeup/ breakout wrenches.

Though prior art makeup/breakout wrenches have worked efficiently in many applications, there is a need for an improved wrench capable of exerting higher torques on drilling tubulars, without allowing the tubulars to slip with respect to the wrenches. The problem of slippage between the tubular and the makeup/breakout wrenches is particularly acute in connection with small diameter drilling tubulars, where extremely high levels of friction between the jaws of the makeup/-breakout wrenches and the drilling tubulars may be required.

SUMMARY OF THE INVENTION

The present invention is directed to an improved clamp utilizing inserts which are shaped and mounted to provide high levels of friction between the insert and a drilling tubular being clamped by the insert.

According to this invention, a clamp for drilling tubulars is provided which includes at least one movable jaw having a face situated adjacent to a drilling tubular being clamped, and means for positioning the jaw to clamp the tubular. The face of the jaw defines at least one recess adjacent the face, which recess is bounded by a surface which defines a portion of a first cylinder. An insert is rotatably positioned within the recess. This insert defines a toothed surface which extends beyond the face of the jaw to contact and frictionally engage the tubular and a positioning surface which defines a portion of a second cylinder, smaller than the first cylinder, such that the insert is rotatably mounted in the recess. Means are provided for positioning the insert in the recess such that the insert is free to rotate within the recess through a selected range to allow the toothed surface to orient into contact with the tubular, yet the insert is impeded from rotating beyond the selected range. This invention is also directed to inserts for use in such a clamp.

In one preferred embodiment described below, the insert for the clamp of this invention is a cylindrical element which defines a cylindrically concave toothed surface and a cylindrically convex positioning surface. The toothed surface defines an array of teeth shaped and positioned to engage the clamped tubular, while the positioning surface is shaped to secure the cylindrical element in the mounting recess defined by the clamp to allow the element to rotate in the recess. As described below, in this preferred embodiment the insert is reversible in the recess, and it utilizes asymmetrical teeth. By merely orienting the insert appropriately, the clamp can readily be configured to exert maximum frictional forces against the clamped tubular either when the clamp is being used to rotate the tubular in a clockwise or alternately a counter-clockwise direction.

The clamp and insert of this invention provide a number of important advantages. Since the insert is free to rotate in the jaw of the clamp within a selected range, it can orient itself as necessary to conform to the surface of the clamped tubular in order to maximize the contact area between the teeth of the insert and the clamped tubular. When the toothed surface is provided with a radius of curvature corresponding to that of the clamped tubular, the contact area between the teeth of the insert and the clamped tubular can be maximized.

Furthermore, certain of the preferred embodiments described below utilize asymmetrically shaped teeth which are optimized for gripping a drilling tubular for rotation in a selected direction. The insert is reversible such that the same insert can be used either to rotate a clamped tubular in the clockwise or the counter-clockwise direction.

The improved clamp and insert of this invention are particularly useful in connection with makeup/breakout devices. Such devices, as explained above, are used to tighten and loosen threaded connections between adjacent lengths of tubulars such as drill pipe. The improved clamp and insert of this invention provide an excellent frictional engagement between the clamp and the clamped tubular in order to provide the high torque needed to break threaded connections between adjacent drilling tubulars in some applications.

The invention itself, together with further objects and attendant advantages, will best be understood by reference to the following detailed description taken in conjunction with the accompanying drawings.

DETAILED DESCRIPTION OF THE PRESENTLY PREFERRED EMBODIMENTS

Figure 1A:
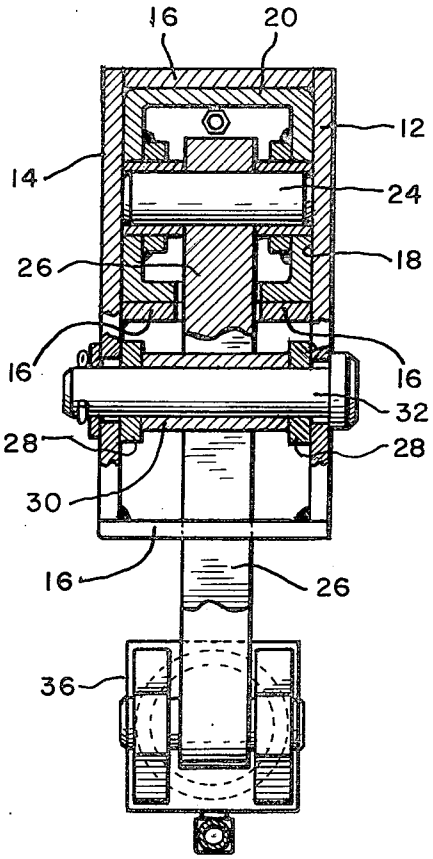
FIG. 1*a* is a side view of the clamp of FIG. 1.
Figure 1:
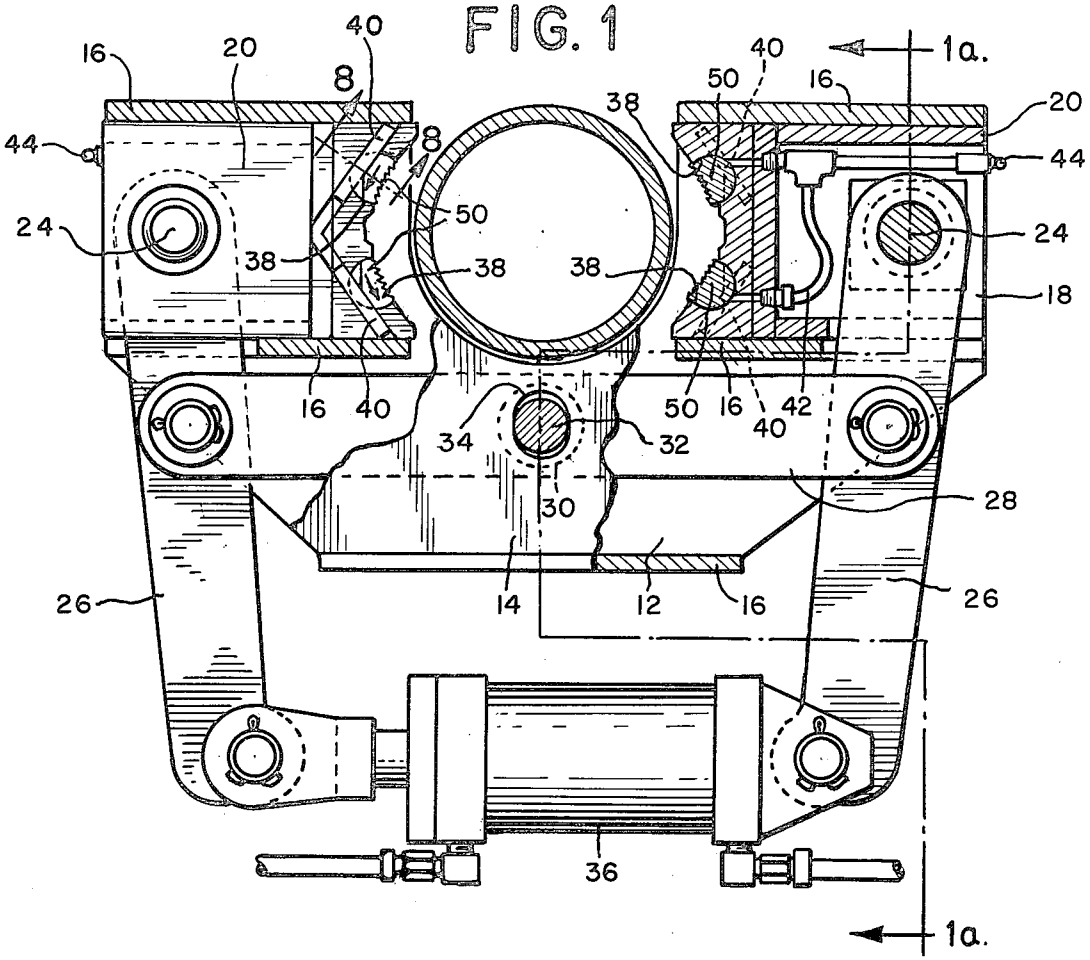
FIG. 1 is a plan view in partial cutaway of a presently preferred embodiment of the clamp of this invention.

Turning now to the drawings, FIG. 1 shows a plan view in partial cutaway of a clamp 10 which incorporates the presently preferred embodiment of this invention. The clamp 10 is in many ways similar to the clamp disclosed in co-pending patent application Ser. No. 182,771 filed Aug. 29, 1980 and assigned to the assignee of this invention. This clamp 10 comprises two spaced, parallel side plates 12,14 which are held together as shown in FIG. 1*a* by edge plates 16. The side plates 12,14 and the edge plates 16 cooperate to define two coaxial rectangular channels 18. Each of the channels 18 serves to guide the movement of a respective rectangular jaw 20 such that the jaws 20 are confined to rectilinear motion.

Each of the jaws 20 defines a respective face 22. The faces 22 are positioned adjacent the space occupied by a drilling tubular 80 when the tubular 80 is clamped by the jaws 20. Each of the jaws 20 defines a respective pin 24 which serves to mount a respective rocker arm 26. The two rocker arms 26 are pivoted about respective ends of two tension straps 28. The spacing between the rocker arms 26 and the tension straps 28 are defined by cylindrical sleeves 30. A pin 32 is mounted between the tension straps 28, and the pin 32 engages two elongated slots 34, each of which is defined by a respective one of the two side plates 12,14. These slots 34 serve to position the pins 32 while allowing the pins 32 limited motion towards and away from the clamped tubular 80.

In an alternative embodiment (not shown) the pin 32 and slot 34 can be eliminated and a key and keyway arrangement substituted therefor. In this alternative embodiment, each of the straps 28 includes a key on its outboard face aligned with the section line 1*a*—1*a* of FIG. 1. Furthermore, means are mounted on the inside surfaces of the side plates 12,14 for defining keyways that mate with the keys to provide the straps 28 with a degree of mobility similar to that of the illustrated embodiment.

A hydraulic cylinder 36 is positioned between the extreme ends of the two rocker arms 26. The rocker arms 26, tension strap 28, and hydraulic cylinder 36 cooperate such that when the hydraulic cylinder 36 elongates, the rocker arms 26 pivot about the ends of the tension straps 28 so as to cause the jaws 20 to approach one another. Conversely, when the hydraulic cylinder 36 is shortened, the rocker arms 26 rotate in the reverse direction so as to cause the jaws 20 to move away from one another. In both cases, the movement of the jaws 20 is guided by the channels 18.

The foregoing details of the clamp 10 are in many respects similar to the clamp disclosed in the above referenced application Ser. No. 182,771. That application is hereby incorporated by reference for a more detailed understanding of the general nature and structure of the clamp 10.

Each of the jaws 20 defines two elongated recesses 38 at its respective face 22. Each of these recesses is defined by a portion of a cylinder, and extends completely through the respective jaw 20. Lubricant conduits 42 extend from the recesses 38 to a centrally located nipple 44 in each jaw 20. These nipples 44 can be used to introduce a lubricant such as a grease into the conduits 42 and thereby into the recesses 38.

Figure 2:
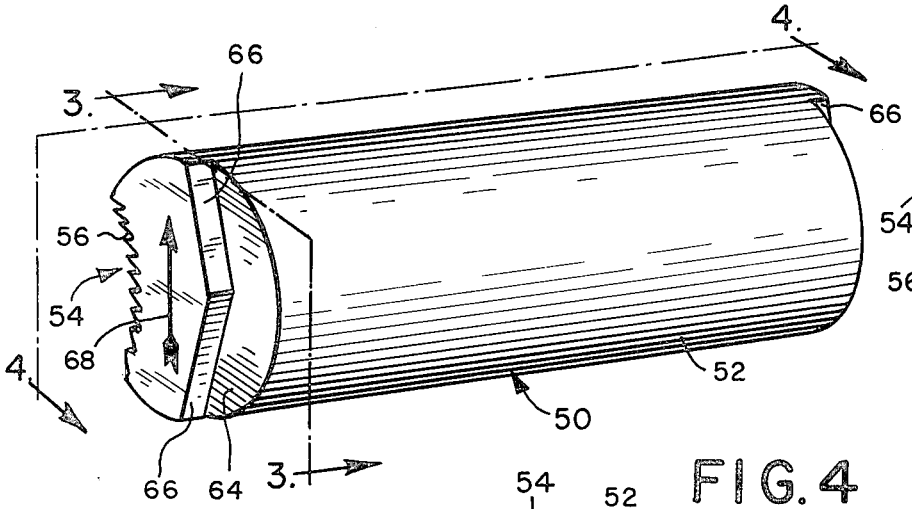
FIG. 2 is a perspective view of a first preferred embodiment of the insert of this invention.

Turning now to FIG. 2, the clamp 10 utilizes four cylindrical inserts 50. Each of these inserts 50 defines a cylindrically convex positioning surface 52 and a cylindrically concave toothed surface 54, and respective end faces 62 are defined at each end of the cylindrical inserts 50.

Figure 3:
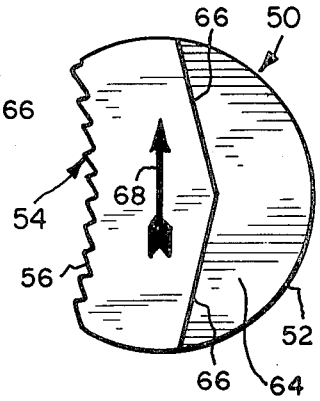
FIG. 3 is an end view taken along line 3—3 of FIG. 2.
Figure 4:
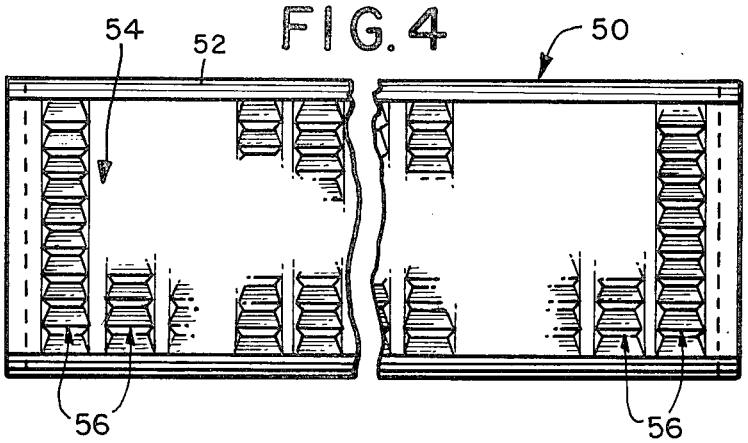
FIG. 4 is an elevational view taken along line 4—4 of FIG. 2.

The configuration of the toothed surface 54 is shown in greater detail in FIGS. 3 through 7. As best seen in FIGS. 3 through 6, the entire toothed surface 54 is covered by an array of teeth 56. Each tooth 56 defines a short face 58 and a long face 60. Thus, each of the teeth 56 is asymmetrical in cross section. In this preferred embodiment, the radius of curvature of the toothed surface 54 at the root of the teeth 56 is 3 and 37/64 inches, and the radius of curvature of the toothed surface 54 at the tips of the teeth 56 is 3 and ½ inches, for a nominal 7 inch diameter tubular joint. Though FIG. 4 shows the teeth 56 as arranged in a rectangular pattern, it should be understood that other patterns, such as helical patterns for example, can also be used to arrange the teeth 56 on the toothed surface 54.

As shown in FIG. 3, the positioning surface 52 of the cylindrical insert 50 is cylindrically convex and extends over between 210° to 300° of the total circumference of the insert 50. In this preferred embodiment, the radius of curvature of the positioning surface 52 is 2 inches and extends over about 240°. The radius of curvature of the positioning surface 52 is choosen such that each of the inserts 50 will fit within a respective one of the recesses 38 so as to be free to rotate within the recess 38.

Figure 8:
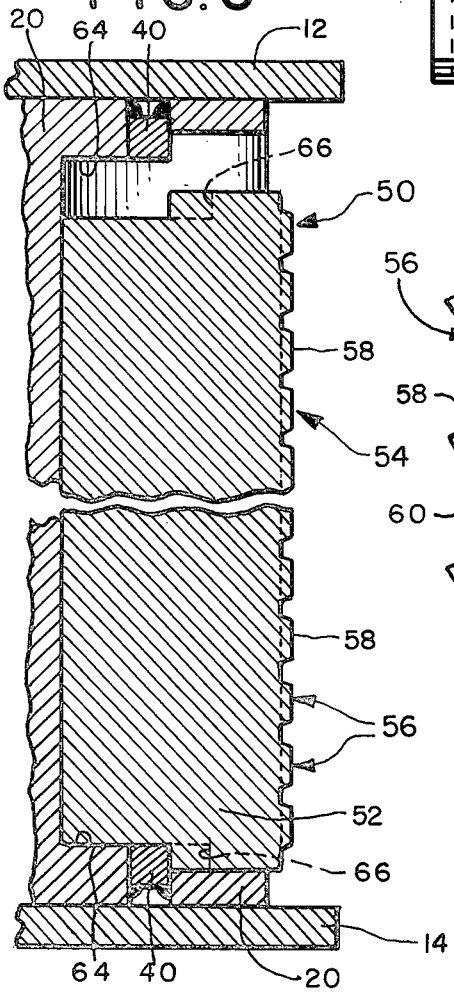
FIG. 8 is a sectional view taken along line 8—8 of FIG. 1.
Figure 6:
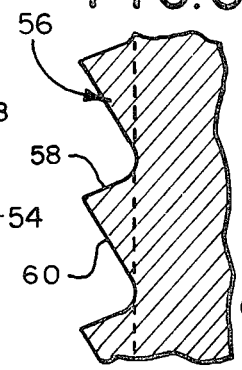
FIG. 6 is a sectional view taken along line 6—6 of FIG. 5.
Figure 5:
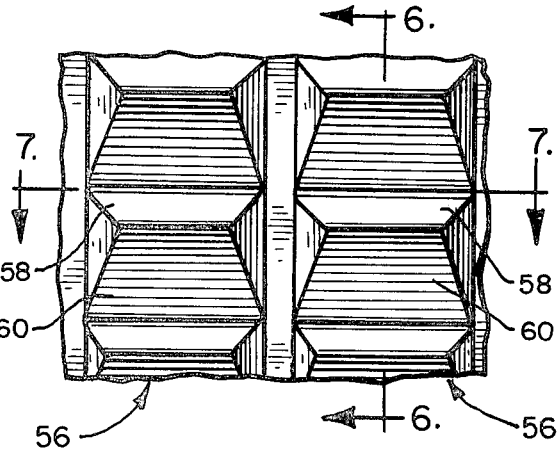
FIG. 5 is an enlarged view taken along line 6—6 of FIG. 3 showing two of the teeth of the insert of FIG. 2.
Figure 7:
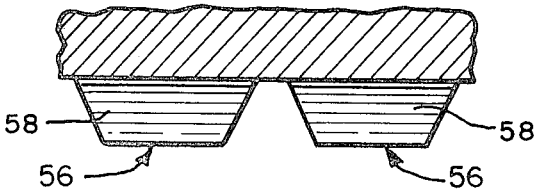
FIG. 7 is a sectional view taken along line 7—7 of FIG. 5.

As shown in FIGS. 3 and 8, each of the end faces 62 of the insert 50 defines a recess 64 which is bounded by a recess wall 66. As shown in FIG. 3, the recess wall 66 is formed of two rectilinear portions which meet at an apex at an angle of about 150°. Each of the end faces 62 is marked with a visable marking such as an arrow 68 which is indicative of the orientation of the asymmetrical teeth 56. As shown in FIG. 3, in this preferred embodiment the arrows 68 on the end faces 62 point from the long faces 60 to the short faces 58 of the teeth 56.

The manner in which the inserts 50 are held in place within the recesses 38 can best be understood by reference to FIGS. 1 and 8. As can be seen from FIGS. 1 and 8, each of the jaws 20 includes a total of four locking bars 40, one positioned to cut across each end of each of the two recesses 38. In the embodiment of FIG. 1 the locking bars 40 adjacent both the side plates 12,14 are fixedly mounted in place, as for example by welding to the jaws 20. As shown in FIG. 8, the locking bars 40 are positioned to abut a portion of the recess wall 40 on the end faces 62 of the inserts 50. Thus, the locking bars 40 serve two functions: (1) they prevent the inserts 50 from sliding out of the jaws 20 in a direction perpendicular to the plane of FIG. 1, and (2) they restrict the rotational movement of the inserts 50 within the recesses 38. Thus, the locking bars 40 maintain the inserts 50 generally in the rotational position shown in FIG. 1, such that the toothed surfaces 54 of the respective inserts 50 are positioned approximately as required to engage the clamped tubular 80 frictionally. However, it is preferable to configure the walls 66 of the end faces 62 such that each of the inserts 50 is free to rotate within the respective recess 38 through a limited range of rotational positions to accomodate varying tubular diameters. In this preferred embodiment that range of positions is about 25°. This limited rotational freedom allows the inserts 50 to orient themselves as necessary to insure maximum contact between the inserts 50 and the clamped tubular 80, thereby optimizing frictional engagement between the inserts 50 and the tubular 80.

It should be noted that the inserts 50 are shaped so as to be reversible. That is, each of the inserts 50 can be inserted within the respective recess 38 in either of two orientations. In the first orientation, the asymmetrical teeth 56 are oriented so as to maximize frictional engagement with the tubular 80 when rotating the tubular 80 in a clockwise direction; in the second orientation, the teeth are oriented so as to maximize frictional engagement with the tubular 80 when the tubular 80 is being rotated in a counter-clockwise direction. Whenever it is necessary to move an insert 50 from the first orientation to the second orientation, the insert 50 is first longitudinally centered between the locking bars 40, rotated by about 90° within the recess 38, and then moved out of the recess 38 away from the jaw 20. The insert 50 is then turned end for end, and replaced in the recess 38. It should be noted that the symmetrical configuration of the recesses 64 and the recess walls 66 in the end faces 62 of the insert 50 provide a particularly simple construction which allows the insert 50 to be turned end for end in the recess 38 without impairing the function of the locking bars 40.

The insert 50 of this preferred embodiment is preferably formed of a suitable steel alloy such as 8620, 4140 or 4340. In this embodiment, the insert 50 is case hardened to provide the teeth 56 with a nominal hardness of Rockwell C55. The insert 50 can be formed by machining techniques, die casting techniques, or investment casting techniques, for example. As an alternative to case hardening, the insert 50 can be carborized.

From the foregoing, it should be apparent that a clamp and insert have been described which provide a number of important advantages. The cylindrically concave toothed surface provides maximum contact area between the insert and a clamped tubular over a range of tubular diameters. The rotational freedom of the insert within the jaw of the clamp allows the insert to position itself as necessary to insure that substantially all of the teeth are positioned to grip the tubular effectively. The reversible feature of the insert in conjunction with the asymmetrical shape of the teeth provides an insert whioh can be optimized for frictional engagement of the clamp tubular in a particular direction of movement. Then, as explained above, the insert can merely be turned end for end to reconfigure the clamp for optimum frictional engagement with the tubular in a reversed direction. The high torque capabilities of this clamp make it particularly well suited for use in makeup/breakout devices of the type required by many drilling devices.

Figure 9:
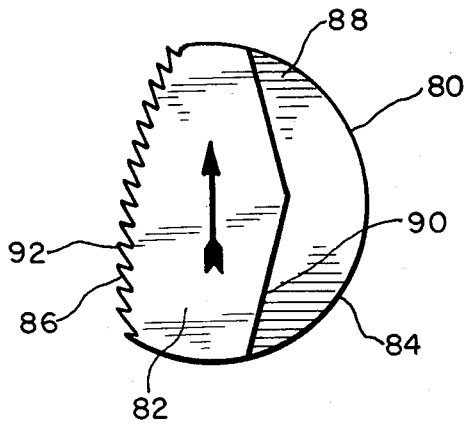
FIG. 9 is an end view, corresponding to the view of FIG. 3, of a second preferred embodiment of the insert of this invention.
Figure 10:
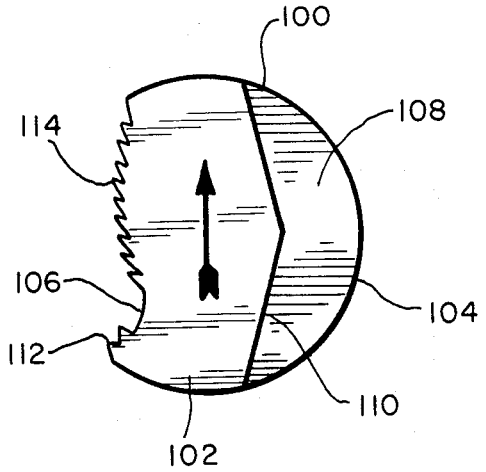
FIG. 10 is an end view, corresponding to the view of FIG. 3, of a third preferred embodiment of the insert of this invention.
Figure 11:
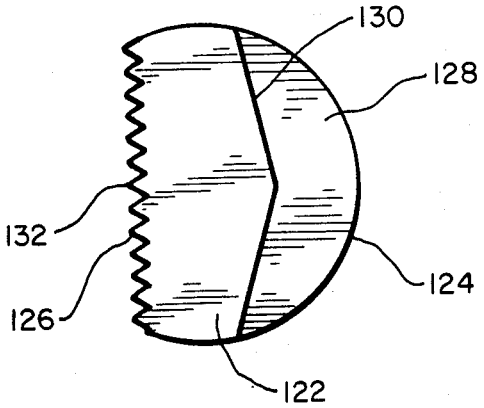
FIG. 11 is an end view, corresponding to the view of FIG. 3, of a fourth preferred embodiment of the insert of this invention.

Turning now to FIGS. 9–11, it should be understood that the insert of this invention can be provided with a toothed surface having a wide variety of shapes and teeth.

For example, FIG. 9 shows an end view of a second insert 80 which can be used interchangeably with the insert 50 in the clamp 10. The insert 80 defines end faces 82, a positioning surface 84, end recesses 88 and recess walls 90 which are identical to the corresponding elements of the insert 50. However, the toothed surface 86 of the insert 80 is cylindrically convex about a point which is offset with respect to the axis of symmetry of the recess wall 90. In that the toothed surface is convex and offset, the insert 80 grips a clamped tubular with a high camming force so as to engage the teeth 92 of the insert 80 in the clamped tubular.

FIG. 10 shows an end view of a third preferred embodiment 100 of the insert of this invention which also defines end faces 102, a positioning surface 104, end recesses 108 and recess walls 110 which are identical to corresponding elements of the insert 50. The insert 100 includes a toothed surface 106 which defines the complex shape shown in FIG. 10. A portion of the toothed surface 106 defines a region 114 of progressively increasing radius, as measured from the axis of symmetry of the positioning surface 104. This region 114 is cammed against a clamped tubular by the tendency of the insert 100 to rotate in the jaws 20 when the clamp 10 is rotated, thereby providing secure engagement between the insert 100 and the clamped tubular. The toothed surface 106 also defines a heel portion 112 which serves to orient the insert 100 properly on the tubular. A leaf spring (not shown) can be mounted between the recess wall 110 and the locking bars 40 in order to orient the insert 100 properly in the jaws 20 after release of a clamped tubular. The progressively increasing radius portion 114 of the toothed surface 106 provides the important advantage that the clamped tubular contacts the insert 100 near the center of the toothed surface 106 for a wide range of diameters of the tubular. As the teeth on the insert 100 wear, this contact area between the insert 100 and the tubular gradually moves toward the edge of the toothed surface 106, thereby engaging fresh teeth.

FIG. 11 shows a fourth preferred embodiment 120 of the insert of this invention. As before, the end surfaces 122, the positioning 124, the end recesses 128, and the recess walls 130 are identical to corresponding elements of the insert 50. In this case, however, the toothed surface 126 is planar and the teeth 132 are symmetrical. Such a configuration for joints not requiring large tooth forces against the joint, would permit clockwise and counterclockwise use on any joint diameter without reversing the insert 120.

Of course, it should be understood the various changes and modifications to the preferred embodiment described above will be apparent to those skilled in the art. For example, the insert and cylindrical recesses of this invention are not restricted to use in clamps of the type shown. Rather, these inserts and recesses can be used with many different types of clamps for drilling tubulars, many of which will not use the hydraulic cylinder and rocker arm configuration of the clamp described above. Furthermore, the insert of this invention can readily be adapted for use with tubulars of sizes other than the illustrated embodiment described above, and in some applications it may be preferable to utilize a greater or lesser number of inserts in each jaw. It is therefore intended that the foregoing detailed description be regarded merely as illustrative of the presently preferred embodiments, and not as limiting. It is the following claims, including all equivalents, which are intended to define the scope this invention.

I claim:

1. In a clamp for clamping a drilling tubular against rotation, said clamp comprising a jaw having a face adapted to fit adjacent a drilling tubular being clamped, and means for positioning the jaw to clamp the drilling tubular, the improvement comprising:

means for defining at least one insert receiving recess adjacent the face, said insert receiving recess bounded by a surface which defines a portion of a first cylinder;

an insert positioned within the insert receiving recess, said insert defining a toothed surface, which extends beyond the face of the jaw to contact and frictionally engage the drilling tubular, and a positioning surface, which defines a portion of a second cylinder aligned with an insert axis and sized smaller than the first cylinder, such that the insert is rotatable in the insert receiving recess;

means, included in the toothed surface, for defining an array of teeth to oppose rotation of the drilling tubular with respect to the jaw; and means for limiting movement of the insert in the insert receiving recess such that the insert is free to rotate within the insert receiving recess through a selected range to allow the toothed surface to orient into contact with the drilling tubular to accommodate a range of sizes of the drilling tubular, yet the insert is impeded from rotating beyond the selected range;

said insert receiving recess and insert shaped such that the insert is positively captured in the insert receiving recess when the insert is within the selected range, and the insert is readily removable from the insert receiving recess without disassembly of the jaw when the insert is disengaged from the movement limiting means and rotated beyond the selected range to a removal position.

2. The invention of claim 1 wherein the array of teeth comprises a plurality of asymmetrical teeth and the insert can be selectively oriented in the insert receiving recess such that the asymmetrical teeth are oriented in either a first or a second orientation, the first orientation adapted for clockwise rotation of the drilling tubular, the second orientation adapted for counter-clockwise rotation of the drilling tubular.

3. The invention of claim 1 wherein the toothed surface is cylindrically concave.

4. The invention of claim 1 wherein the toothed surface is planar.

5. The invention of claim 1 wherein at least a portion of the toothed surface is cylindrically convex.

6. The invention of claim 1 wherein the movement limiting means comprises means for defining an insert recess bounded by a side wall located in a first end of the insert and a locking bar, included in the jaw, positioned to engage the side wall of the insert recess to restrict the rotational movement of the insert in the insert receiving recess.

7. The invention of claim 2 wherein the insert defines a respective end surface at each end of the insert, and wherein each of the end surfaces defines an arrow positioned to indicate the orientation of the teeth.

8. The invention of claim 1 wherein the jaw comprises means for introducing a lubricant into the insert receiving recess between the jaw and the insert to facilitate rotation of the insert in the insert receiving recess.

9. The invention of claim 1 wherein the insert is shaped as a cylinder having a circularly cylindrically convex surface which defines the positioning surface and a circularly cylindrically concave surface which defines the toothed surface.

10. The invention of claim 9 wherein the circularly cylindrically convex surface extends over about 240° and is characterized by a radius of curvature smaller than that of the circularly cylindrically concave surface.

11. The invention of claim 1 wherein the selected range defined by the positioning means is about 25 degrees.

12. The invention of claim 1 wherein:

the insert receiving recess defines two opposed recess ends at opposed ends of a longitudinal recess axis;

the portion of the first cylinder defines a first circular segment in cross section;

the portion of the first cylinder extends between the two opposed recess ends along the longitudinal axis;

the means for positioning the insert in the insert receiving recess comprises a bar extending across the insert receiving recess at one of the two opposed recess ends and means for defining an insert recess located at a first end of the insert and bounded by a side wall, said side wall positioned to engage the bar to limit rotation of the insert in the insert receiving recess;

the portion of the second cylinder defines a second circular segment in cross section; and the insert and insert receiving recess are shaped such that the insert is positively retained in the insert receiving recess when the insert is oriented with the side wall is engagement with the bar, and the insert is removable from the insert receiving recess when the insert is shifted along the longitudinal recess axis and rotated in the insert receiving recess, such that the insert is removable without disassembly of the means for defining the insert receiving recess.

13. The invention of claim 1 wherein:

the insert receiving means defines two opposed recess ends at opposed ends of a longitudinal recess axis;

the means for positioning the insert in the insert receiving recess comprises a bar extending across the insert receiving recess at one of the two opposed recess ends and meand for defining an insert recess located at a first end of the insert and bounded by a side wall, said side wall positioned to engage the bar to limit rotation of the insert in the insert receiving recess; and the insert and insert receiving recess are shaped such that the insert is positively retained in the insert receiving recess when the insert is oriented with the side wall in engagement with the bar, and the insert is removable from the insert receiving recess when the insert is shifted along the longitudinal recess axis and rotated in the insert receiving recess, such that the insert is removable without disassembly of the means for defining the insert receiving recess.

14. An insert for a clamp for drilling tubulars, said insert comprising:

a cylindrical element defining a longitudinal axis, a cylindrically convex positioning surface which forms a circular segment in cross section, a toothed surface, and two opposed end surfaces, each extending between the cylindrically convex positioning surface and the toothed surface at a respective end of the cylindrical element;

said toothed surface defining an array of teeth;

each of said end surfaces defining a respective recess bounded by a respective recess wall, each recess wall comprising two rectilinear wall segments which meet at an obtuse angle.

15. The invention of claim 14 wherein the toothed surface is cylindrically concave and wherein the cylindrically concave toothed surface defines a radius of curvature greater than that of the cylindrically convex positioning surface.

16. The invention of claim 15 wherein the teeth are asymmetrical and oriented parallel to the longitudinal axis.

17. The invention of claim 14 wherein the toothed surface is planar.

18. The invention of claim 14 wherein at least a portion of the toothed surface is cylindrically convex.

* * * * *